United States Patent [19]

Bolte

[11] Patent Number: 4,842,887

[45] Date of Patent: Jun. 27, 1989

[54] METHOD OF AND SYSTEM FOR COATING EXPOSED CAN EDGES

[75] Inventor: Georg Bolte, Vechelde, Fed. Rep. of Germany

[73] Assignee: Schmalbach-Lubeca AG, Brunswick, Fed. Rep. of Germany

[21] Appl. No.: 208,826

[22] Filed: Jun. 15, 1988

Related U.S. Application Data

[63] Continuation-in-part of Ser. No. 6,763, Jan. 27, 1987, abandoned.

[30] Foreign Application Priority Data

Feb. 1, 1986 [DE] Fed. Rep. of Germany ..... 3603126

[51] Int. Cl.[4] ..... B05D 1/02; B05B 15/04

[52] U.S. Cl. ..... 427/10; 29/527.2; 29/527.4; 118/324; 118/669; 118/670; 118/679; 427/142; 427/421; 427/424

[58] Field of Search ..... 427/10, 142, 287, 424, 427/14.1, 284, 421; 118/669, 670, 679, 326, 324; 346/75; 29/527.2, 527.4

[56] References Cited

U.S. PATENT DOCUMENTS 4,269,874 5/1981 Pryor et al. ..... 427/282

FOREIGN PATENT DOCUMENTS 0209896 1/1987 European Pat. Off. .
2159377 6/1972 Fed. Rep. of Germany .

OTHER PUBLICATIONS

Hawley, G. G., *The Condensed Chemical Dictionary,* N.Y., Van Nostrand Reinhold Company, 1977, p.646.

*Ink Jet Printing: Current Status and Future Prospects,* vol. I, Maine, U.S.A., Gorham International, Inc., pp. 346–355.

"Typische Lackformulierungen", from *Lacke und Losemittel,* Weinheim, West Germany, Verlag Chemie, 1979, pp. 32–34.

Kittel, H., *Lehrbach der Lacke und Beschichtungen Band III,* Verlag W. A. Colomb, 1976, pp. 70, 71 and 108–117.

*Losemittel Hoechst,* vol. 5, Frankfurt, West Germany, 1987, pp. 310–311.

*Primary Examiner*—Evan Lawrence

*Attorney, Agent, or Firm*—Herbert Dubno

[57] ABSTRACT

At least one complete surface of at least one metallic part of a can is given a uniform coating of corrosion-preventing lacquer and this part is subsequently worked such that the metal of the part is exposed at regions at least immediately adjacent the coated surface. Dots of lacquer are sprayed by the ink-jet method substantially only on the exposed regions of the part after working thereof and so that the dots together form a continuous layer covering the exposed regions. According to the viscosity of the lacquer the surface coating can be achieved by partially overlapping adjacent dots of the applied lacquer or without overlapping by the running together of the adjacent dots of the liquid, with no excess material having to be applied to and subsequently removed from the regions to be coated.

11 Claims, 1 Drawing Sheet

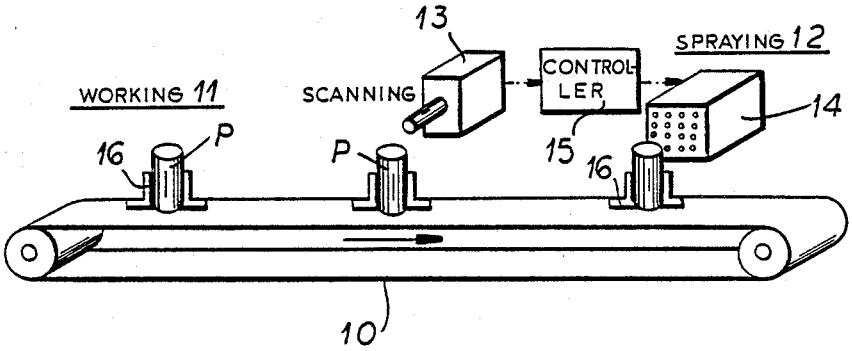
13
SPRAYING 12
CONTROL-
LER
WORKING 11
SCANNING
14
16
P
P
15
16
10

METHOD OF AND SYSTEM FOR COATING EXPOSED CAN EDGES

This is a continuation-in-part of co-pending application Ser. No. 006,763 filed on Jan. 27, 1987, now abandoned.

FIELD OF THE INVENTION

The present invention relates to a method of and system for coating exposed edges of otherwise coated packaging containers. More particularly this invention concerns the coating of exposed edges created in already painted cans and parts thereof.

BACKGROUND OF THE INVENTION

It is standard practice in the production of metallic packaging containers and parts thereof, hereinafter generically referred to as cans, to apply a coating of an anticorrosion agent, hereinafter referred to as lacquer, to the can before it is completely assembled. Thus, for example, the sheet-metal rectangle that is eventually formed into a cylindrical tube and joined to two disks to form a three-part can is imprinted with product information and so on while it is still planar. trying to accurately print and/or coat a finished can is relatively difficult, especially when the coating job must be fairly detailed and complex as is usually the case.

During the subsequent working operations the thus coated can part is often cut, scratched, soldered, or deformed so that some of the coat is locally damaged or removed, or so that raw metallic edges are left. In addition it is not unknown to leave some parts uncoated right from the start as the coating would inhibit later operations, such as soldering. When the can is made from steel it is, however, essential that all exposed metal be painted in order to prevent corrosion.

As a result, in order to avoid damaging the overall coating of the cans during subsequent deformation or treatment, lacquers are used which are relatively soft and therefore are quite stretchable as well as mechanically fairly rugged. Such lacquers are however relatively expensive and are difficult to make due to the particular requirements. According to the type of deformation or of working which the already lacquered cans are subjected to, lacquers of different composition are necessary. Even when such lacquers are used, corrosion-prone locations are always left when the cans are subjected to cutting or stamping after their coating. This produces raw edges which can never be covered by the originally applied coating on the cans.

In order to avoid the above-mentioned disadvantages and difficulties processes are known to recoat the areas of that were damaged or where the lacquer was removed in the treatment processes. In order to apply this second coating of lacquer it is known to subject the cans to an electro-dip coating wherein at least the corrosion-prone regions of the cans are moved through the bath. In another process the corrosion-prone regions are electrostatically coated with powder and corrosion protection is obtained by melting the powder at these locations.

These two known methods are relatively expensive and necessitate quite a bit of equipment to carry them out, which, in particular when the localized damage is relatively limited as for example at the edges of cuts or stampings, is uneconomic. In addition it is necessary with these methods to make up separate batches of lacquer for the overall painting and for the subsequent coating of the damaged locations.

OBJECTS OF THE INVENTION

It is therefore an object of the present invention to provide an improved method of and system for touching up the coating job of a can part that was already coated, whether or not it has been made into a finished can.

Another object is the provision of such a system and method that overcome the above-given disadvantages, that is which is able to coat the localized damage of the cans in a precise manner with a minimum of lacquer and using the same lacquer as used for the prior overall coating.

SUMMARY OF THE INVENTION

At least one complete surface of at least one metallic part of a can is given a uniform coating of corrosion-preventing lacquer and this part is subsequently worked such that the metal of the part is exposed at regions at least immediately adjacent the coated surface. According to this invention dots of lacquer are sprayed by the ink-jet method substantially only on the exposed regions of the part after working thereof and so that the dots together form a continuous layer covering the exposed regions.

By means of the ink-jet method it is possible, without respect to the geometry of the cans or of their localized damage, to produce an accurate coating that only covers the region of the damage. Thus it is possible to limit the coating to narrow regions, such as scratches or cut lines, without having to resort to a dip treatment or a heat treatment, as for example for the remelting of an electrostatically applied powder. The coating can therefore be done on stationary or fixedly held cans as well as during their movement or their transport. As a result of the localized and dosed application of the lacquer according to the ink-jet method only a very short time is typically necessary for the coating of small regions, and the coating thickness can be varied. According to the viscosity of the lacquer, the surface coating can be achieved by partially overlapping adjacent dots of the applied lacquer, or without overlapping by the running together of the adjacent dots of the liquid, with no excess material having to be applied to and subsequently removed from the regions to be coated.

Thus in accordance with the method of this invention the metallic can part is displaced after being worked on to a coating station provided with an ink-jet nozzle assembly and the dots are sprayed from the assembly onto the exposed regions. As mentioned either the parts are immobilized in a predetermined position in the station during the spraying, or they are sprayed as they are moved through the station. In the latter case they are immobilized in a predetermined position on a conveyor as they are passed through the station and sprayed.

It is possible by means of these procedures to orient all of the cans before the dot-wise application of the lacquer so that the identical regions of damage caused by the subsequent treatment of the cans are in the same location as they pass the nozzle arrangement, making it particularly easy to control the nozzle arrangement. On the other hand it is also possible to control the spray nozzles of a nozzle arrangement depending on the particular position of the damage on the cans so that the streams emitted by the nozzles impinge only upon the damaged regions with the above-mentioned partial overlap of adjacent dots.

Preferably the coating of the damaged regions of the cans takes place during transport of these parts. A particularly advantageous arrangement has a stationary nozzle arrangement past which the cans are conveyed and working with an upstream device for positioning the cans in and/or holding them in a predetermined position relative to the nozzle arrangement.

According to a further feature of this invention the parts are scanned after being worked to produce a scanner output representing at least the locations on the parts of the respective exposed regions. The nozzle assembly is operated to spray the dots on the respective regions of the parts in accordance with the respective scanner output. This scanner output is a succession of image points.

BRIEF DESCRIPTION OF THE DRAWING

The above and other features and advantages will become more readily apparent from the following, reference being made to the sole FIGURE of the drawing which schematically represents the system of this invention.

SPECIFIC DESCRIPTION

As seen in the drawing a conveyor 10 transports the part P after working at a station 11 to a sprayer station 12 and a scanner 13 examines the can part P upstream of the station 12 and generates a scanner output representing the locations on the can part P of the respective exposed regions. An ink-jet sprayer 14 is operated by a controller 15 also connected to the scanner 13 so as to spray dots of lacquer therefrom substantially only on the exposed regions of the part P after working thereof such that the dots together form a continuous layer covering the exposed regions.

There are several aspects of ink-jet printing. A dot or drop of liquid is sprayed by an ink-jet printer in either of two main ways:

In the first system of a valve provided upstream of a nozzle allows the nozzle to be connected to or isolated from a pressurized source of the liquid being sprayed. The valve is open for a very brief instant to allow a high-pressure drop of liquid to pass from the source to and through the nozzle.

In the second main system a piezoelectric body has a passage which at its rear end is connected to a source of the liquid so as to naturally fill the passage by capillary action. The front end of this passage is formed with, or connected to, a nozzle directed at the place to be sprayed. An electric force is applied to the body to close the passage from the rear forward, thereby projecting all of the liquid in the passage as a drop from the front end of the passage.

There are three main characteristics of the liquid or lacquer being sprayed that have importance. Firstly, the viscosity of the liquid must be kept low to allow it to flow in the nozzle. If the viscosity is too low the recovery time for the printer is much too slow. Secondly, the surface tension must be high in order to form a coherent drop that will stay together as it is projected onto the object being coated, and so that it will not splatter and flow out when it does indeed land where it is too dry. Thirdly, the liquid must not contain any significant particulate phase, at least one with particles large enough to block the tiny passages in the ink-jet nozzle.

Lacquer, preferably clear lacquer, is the liquid that is sprayed in the present process. Very small amounts of pigment material may be included in the lacquer although these amounts will be substantially less than normally found in paint. A liquid suitable as a lacquer should have a viscosity in the range from about 0.5 to about 10 $m^2/S$ at 22° C., preferably between about 1 and 5 $m^2/S$, optimally about 1.8 $m^2/S$. Surface tension of a lacquer will normally range from about 25 to 45 dynes/cm, preferably from about 30 to 36 dynes/cm, optimally about 39 dynes/cm.

An important component of the lacquer is a binder which may be a polymer or copolymer. Illustrative of the binder is a combination of an acetal of polyvinyl alcohol, a portion of an epoxide resin, and a further portion of non-plasticized methyl ester of a melamine-formaldehyde resin. Solvent for such binding material can be a combination of alcohols and aromatic hydrocarbons. The ratio of binder to solvent may range from about 1:2 to 1:50, preferably about 1:4 to 1:10, optimally about 1:6. Further information on typical lacquers may be found in the following sources:

*Ink Jet Printing: Current Status and Future Prospects* (Gorham International Inc., Maine, USA Vol, 1, pages 346-355);

pages 32, 33 and 34 of "Typische Lackformulierungen from *Lacke und Losemittel* (Verlag Chemie, 1979; Weinheim, West Germany);

pages 70, 71 and 108 through 117 of Lehrbuch der Lacke und Beschichtungen Band III by H. Kittel (Verlag W.A. Colomb; 1976); and pages 310 and 311 of *Losemittel Hoechst* (Volume 5, 1987; Frankfurt, West Germany), all of which are herein incorporated by reference.

In order to assure a localized and sure coating of the locally limited subsequently treated locations of the containers or of the parts thereof, it is advantageous to scan the corrosion-prone regions on the cans optically or electrically or electronically, and to convert the scanner output into control signals for positioning the cans or can parts relative to the sprayer and/or to program the sprayer to apply the dots of the lacquer to the corrosion-prone regions.

The above-described arrangement is formed in a simple manner as an additional station of a treatment machine, one in which the parts P being worked on by the machine are held in predetermined relative positions by a holding device 16 as they are moved along and in which the areas that are damaged or otherwise free of lacquer are coated. If the can parts P have a predetermined position relative to the nozzle arrangement of the sprayer 13 or are placed in such a position, the nozzle arrangement can in a very simple manner have a shape corresponding to that of the particular corrosion-prone region of the containers or containers. With a simple nozzle arrangement it is therefore possible to use a very simple system for controlling the nozzles in order with stationarily held cans to obtain a coating of the damaged regions.

If it is necessary to coat the regions that are damaged or free of lacquer without beforehand positioning the cans with the ink-jet method it is advantageous to provide equipment for optically or electronically detecting the position of the cans and the corrosion-prone regions thereon as they are being transported and for converting the scanner output or the picture thus taken into image points in turn converted to control signals and to use a nozzle array substantially larger than the corrosion-prone region so as to be able to individually program control of the nozzles of the array.

When optical scanning is employed a camera of the video-camera type is employed by means of which the image taken is converted into image points which are converted in the known manner into control signals in order to operate the programmer for the nozzles.

I claim:

1. In a method of making a can comprising the steps of:

applying to at least one complete surface of at least one metallic pat of a can a uniform coating of corrosion-preventing lacquer; and subsequently working on the part such that the metal of the part is exposed at regions at least immediately adjacent the coated surface, the improvement comprising the step of:

spraying by the ink-jet method dots of lacquer substantially only on the exposed regions of the part after working thereof and so that the dots together form a continuous layer covering the exposed regions.

2. The improved method defined in claim 1, further comprising the step of:

displacing the metallic can part after working thereof to a coating station provided with an ink-jet nozzle assembly, the dots being sprayed from the assembly onto the exposed regions.

3. The improved method defined in claim 2, further comprising the step of:

immobilizing the parts in a predetermined position in the station during the spraying.

4. The improved method defined in claim 2 wherein the parts are sprayed as they are moved through the station.

5. The improved method defined in claim 2, further comprising the step of:

immobilizing the pats in a predetermined position on a conveyor as they are passed through the station and sprayed.

6. The improved method defined in claim 2, further comprising the steps of:

scanning the parts after working thereof and producing a scanner output representing at least the locations on the parts of the respective exposed regions; and operating the nozzle assembly to spray the dots on the respective regions of the parts in accordance with the respective scanner output.

7. The improved method define din claim 6 wherein the scanner output is a succession of image points.

8. A system for coating exposed metallic regions created on an otherwise coated surface of a can part after working of the can part, the system comprising:

conveyor means for transporting the part after working to a sprayer station;

means for scanning the can part after working thereof but upstream of the station and for generating a scanner output representing the locations on the can part of the respective exposed regions;

an ink-jet sprayer; and control means connected to the ink-jet sprayer and the scanning means for operating the sprayer so as to spray dots of lacquer, therefrom substantially only on the exposed regions of the part after working thereof such that the dots together form a continuous layer covering the exposed regions.

9. The system defined in claim 8 wherein the scanning means is optical.

10. The system defined in claim 8 wherein the scanning means is a video camera and the output is a succession of image points.

11. The system defined in claim 8 wherein the sprayer has an array of individually controllable nozzles that is larger than the part.

* * * * *